United States Patent [19]

Russell

[11] 4,262,471

[45] Apr. 21, 1981

[54] ENVELOPE PROCESSING MACHINE

[75] Inventor: Robert J. Russell, Medford, N.J.

[73] Assignee: Mail-Ex Corporation, Skokie, Ill.

[21] Appl. No.: 48,992

[22] Filed: Jun. 15, 1979

[51] Int. Cl.[3] ..... B65B 43/30

[52] U.S. Cl. ..... 53/381 R; 53/569

[58] Field of Search ..... 53/381 R, 384, 569, 53/492, 570

[56] References Cited

U.S. PATENT DOCUMENTS

| | | | |
|---|---|---|---|
| 2,702,150 | 2/1955 | Vogt | 53/570 |
| 3,509,689 | 5/1970 | Perrin | 53/384 X |
| 4,139,977 | 2/1979 | Russell | 53/38 R X |

*Primary Examiner*—John Sipos

*Attorney, Agent, or Firm*—Trexler, Wolters, Bushnell & Fosse

[57] ABSTRACT

There is disclosed a new and improved envelope processing machine. The machine includes a supply hopper for retaining a quantity of envelopes to be processed, cutting means for severing an edge of an envelope, an envelope processing station, envelope feed means, and envelope transmitting means. The envelope feed means removes the envelopes from the hopper and places them onto the transmitting means one at a time in succession. The transmitting means conveys the envelopes to the cutting station whereat an edge of each envelope is severed. The transmitting means then conveys the envelopes one at a time to the envelope processing station which includes envelope opening means having a pair of reciprocating tacky adhesive pads arranged to grip and separate opposite panels of the envelopes to facilitate the removal of contents therefrom.

15 Claims, 8 Drawing Figures

ENVELOPE PROCESSING MACHINE

BACKGROUND OF THE INVENTION

The present invention relates to a new and improved envelope processing machine.

The envelope processing machines are known in the prior art wherein envelopes are removed from a supply hopper, transmitted to a cutting station where one edge of the envelope is cut open, and then transmitted to a removal station wherein the envelope is opened and the contents are mechanically extracted. One such machine is described, for example, in West, U.S. Pat. No. 3,384,252. The present invention provides for the manual removal or insertion of the contents of an envelope at the processing station, thus avoiding the complexity and problems incident to the operation of mechanical processing means.

Envelope processing machines are also known in the prior art wherein envelopes are removed from a supply hopper, severed along one edge at a cutting station, and transmitted to a station whereat the envelope is opened and held open for manual removal of the contents therefrom. Such a machine is fully described and claimed in U.S. Application Ser. No. 801,454 filed May 31, 1977, now U.S. Pat. No. 4,159,611, which is assigned to the assignee of the present invention. The machine there described includes a plurality of reciprocating arms with each such arm terminating with a suction cup coupled to a source of negative air pressure. One such arm is located at the envelope hopper where the suction cup engages the envelopes one at a time and pulls the envelopes to a conveyor. The suction cup is able to grip the envelopes due to the air suction at the suction cup. Similarly, a pair of such arms are located at the processing station with each arm having a suction cup arranged to engage respective side panels of the envelopes for gripping and separating the side panels to dispose the envelopes in an open condition to an operator. Again, the suction at the suction cups facilitates the gripping of the envelope side panels.

While the last mentioned envelope processing machine has exhibited features and advantages over similar machines in the prior art, it is possible that a problem may be encountered at the processing station due to the air suction utilized for gripping and separating the side panels of the envelopes. When envelopes constructed from porous paper material are processed, the air suction utilized for opening the envelopes may pass through the envelope side panels and, as a consequence, hold the contents of the envelope against one of the side panels during the manual extraction process. If this situation should ensue, an operator would have difficulty removing all of the contents from the envelope.

It is therefore a general object of the present invention to provide a new and improved envelope processing machine.

It is a further object of the present invention to provide an envelope processing machine which includes a new and improved envelope opening means which does not rely upon air suction for gripping and separating opposite side panels of an envelope.

It is a still further object of the present invention to provide a new and improved envelope processing machine which includes an envelope opening means having a pair of reciprocating tacky adhesive means arranged to grip and separate opposite panels of an envelope to facilitate the removal of contents therefrom.

The invention therefore provides an envelope processing machine comprising a supply hopper for envelopes, cutting means for severing an edge of an envelope, an envelope processing station, and means for removing envelopes in one-by-one relationship from the supply hopper. The machine further includes transmitting means for transmitting the envelopes to the cutting means and for transmitting the envelopes from the cutting means to the envelope processing station. The envelope processing means includes a pair of reciprocating tacky adhesive means arranged to grip and separate opposite panels of an envelope to facilitate the removal of contents therefrom.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, wherein the several figures like reference numerals identify identical elements, and wherein:

DESCRIPTION OF THE PREFERRED EMBODIMENT

Figure 1:
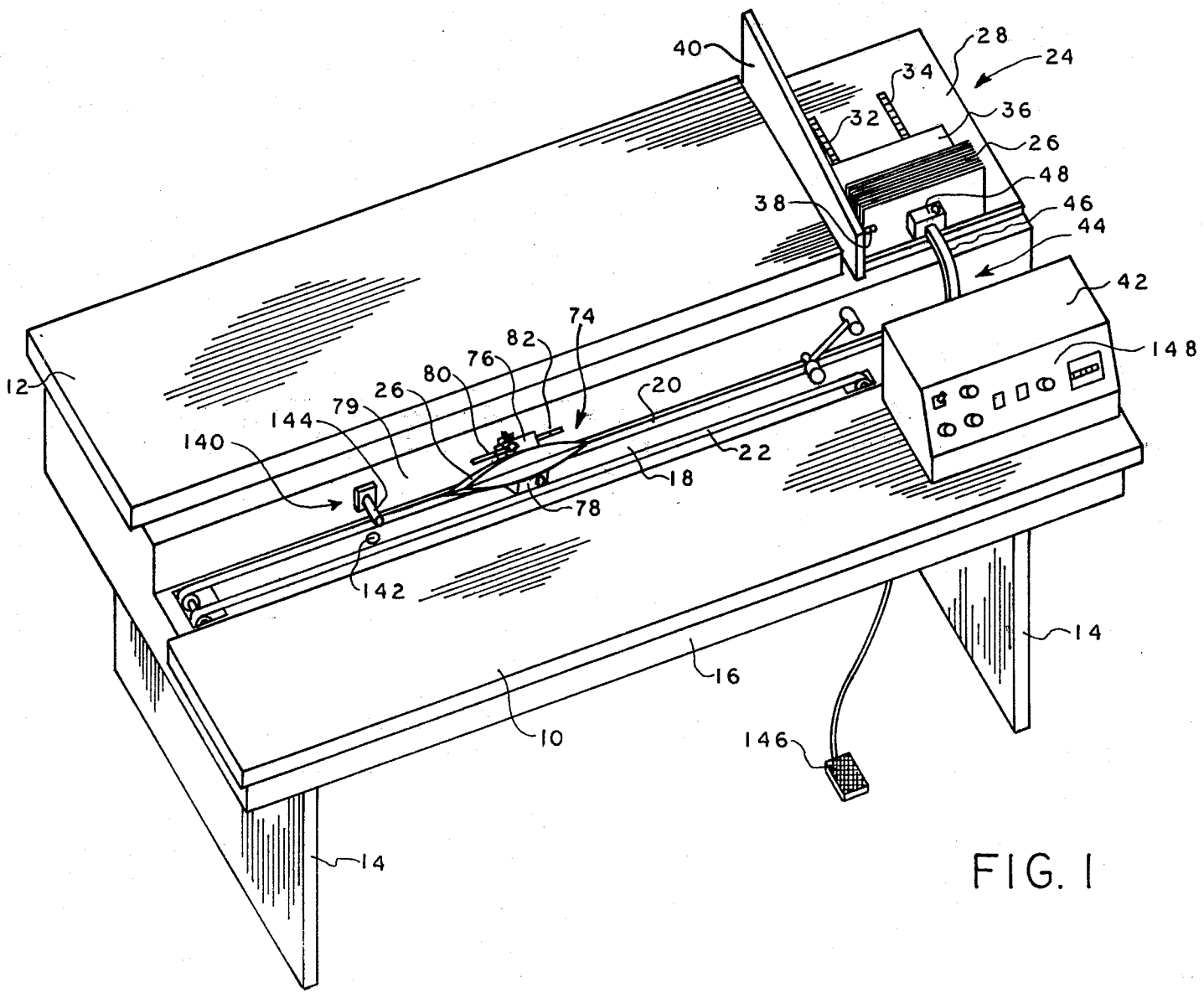
FIG. 1 is a general perspective view showing the machine of the present invention in accordance with one selected embodiment thereof.

Referring now to FIG. 1, the envelope processing machine there shown constructed in accordance with the present invention generally includes lower and upper offset table structures 10 and 12 supported at table height by legs 14. The upper table 12 covers the internal mechanism of the machine and conveniently provides a work and table surface. The operator sits facing the lower table surface 10 and the front panel of the machine indicated by the reference numeral 16. Between the upper table 12 and lower table 10 there is disposed a substantially horizontal plate 18 which extends across substantially the entire width of the machine. The plate 18 supports a pair of endless conveyor belts 20 and 22 which form an envelope transmitting means for conveying the envelopes to be processed from one station of the machine to the next in succession.

To the right of the upper table surface 12 there is provided a supply hopper 24 arranged to contain a plurality of envelopes 26 to be processed. The hopper 24 includes an inclined surface 28, a pair of endless belts 32 and 34 arranged to travel along the surface 28, a weight block 36, and a retainer 38 which projects in the direction of the envelopes 26 from a side abutment plate 40. The envelopes 26 are arranged in stacked relationship and held in that position against the abutment plate 40 by the coaction of the retainer 38 and the weight 36. Between the hopper 24 and the control box 42 of the machine there is provided a feed means 44 which includes a reciprocating arm 46 and an envelope gripper 48 which is constructed in accordance with a particular aspect of the present invention. The arm 46 is arranged to pivot from a retracted position whereat the gripper 48 is beneath the plate 18 to the illustrated position in FIG. 1 for gripping the envelopes 26 one at a time and placing the envelopes onto the conveyor belts 20 and 22. As the arm 46 pivots to its retracted position, the envelope gripped by the gripper 48 is pulled free of the retainer 38 and downwardly to the conveyor. As the feed means 44 operates, the belts 32 and 34 travel along the inclined surface 28 and the weight 36 descends along the inclined surface 28 to provide a continuous supply of stacked envelopes 26 for the feed means 44.

Figure 5:
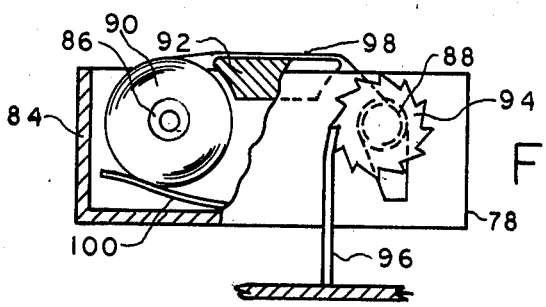
FIG. 5 is a detailed view as seen along line 5—5 of FIG. 4.
Figure 8:
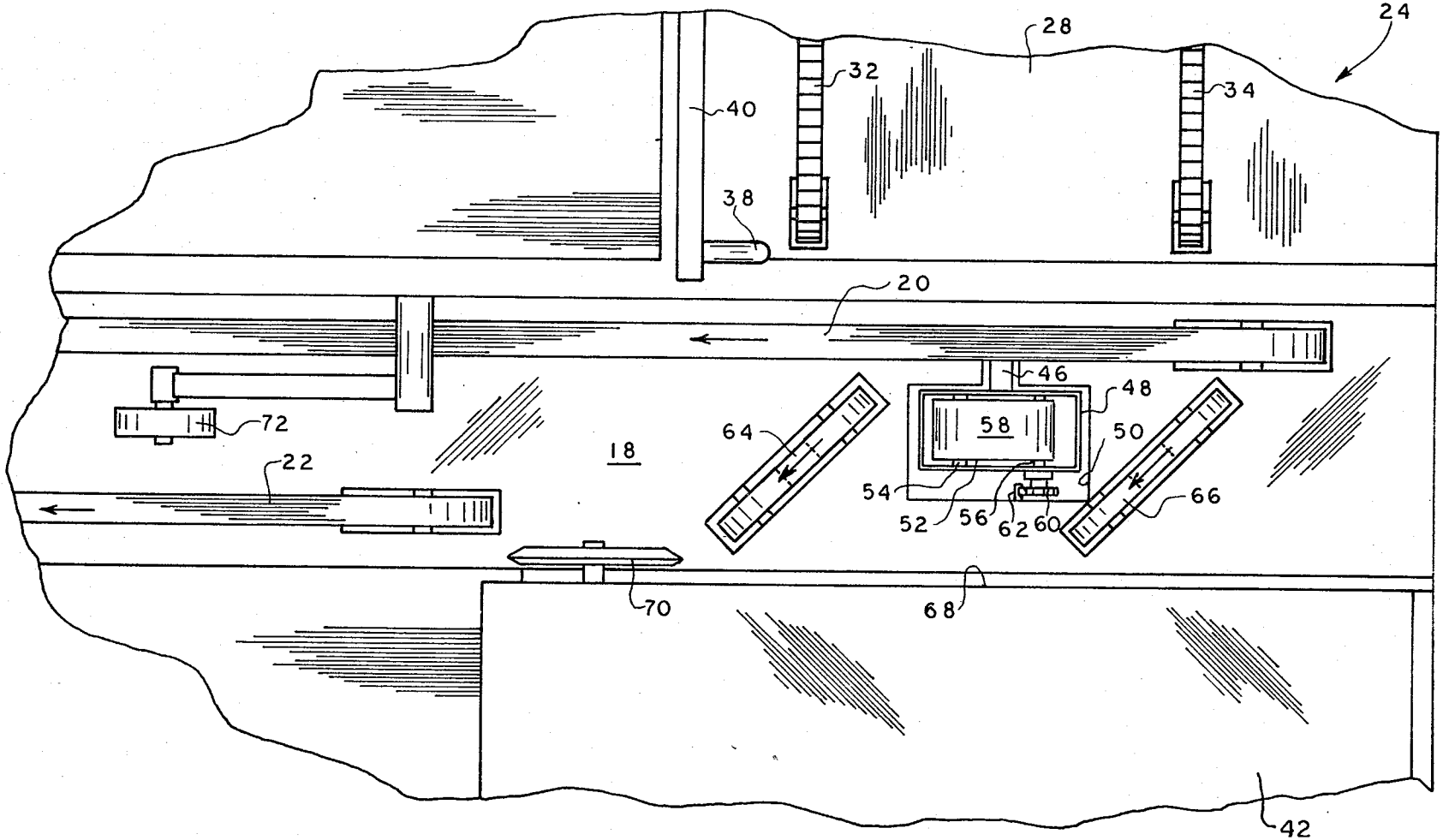
FIG. 8 is a partial plan view of the mechanism for transmitting envelopes from the supply hopper to the cutting station.

Referring now to FIG. 8, it can there be seen that the plate 18 includes an opening 50 which allows the gripper 48 to descend beneath the plate 18. The gripper 48 (similar to gripper 78, FIG. 5, presently to be described) includes a roll of webbing 52 which is supplied by a supply roll 54 and extends across to a take-up roll 56. The webbing 52 includes a tacky adhesive substance on its upper surface 58 for gripping the envelopes upon engagement therewith. Also, as will be described in greater detail with reference to FIG. 5, the take-up roll 56 is coupled to a ratchet wheel 60 which is arranged to engage an incrementing arm 62 for incrementally rotating the take-up roller 56 as the gripper 48 returns to its retracted position to afford a step-by-step fresh supply of tacky adhesive webbing 52. As the arm 46 causes the gripper 48 to descend beneath the plate 18, the envelope is stripped from the tacky adhesive of the web 52 and thereby placed onto the conveyor belt 20.

The envelope transmitting means further includes an additional pair of belts 64 and 66, FIG. 8, which are arranged to travel along a diagonal direction with respect to the travel of the belt 20. The belts 64 and 66 in cooperation with the belt 20 therefore cause the envelopes to travel in a diagonal direction whereby the edge of the envelope to be severed by the cutting means is caused to engage an alignment surface 68.

Once the envelope is so aligned, it will be caused to be conveyed by the aforementioned belts longitudinally to the left as seen in FIG. 8 to a rotary cutting blade 70 which severs the envelopes along an edge thereof. Immediately after being severed by the rotary blade 70, the envelopes are then conveyed by the belts 20 and 22 to the processing station whereat the envelopes are opened and retained in an opened position to afford ready extraction of the contents thereof by an operator. In being so conveyed, the envelopes are caused to pass beneath a pressure roller 72 which assures firm engagement of the envelopes with the belts 20 and 22.

Figure 7:
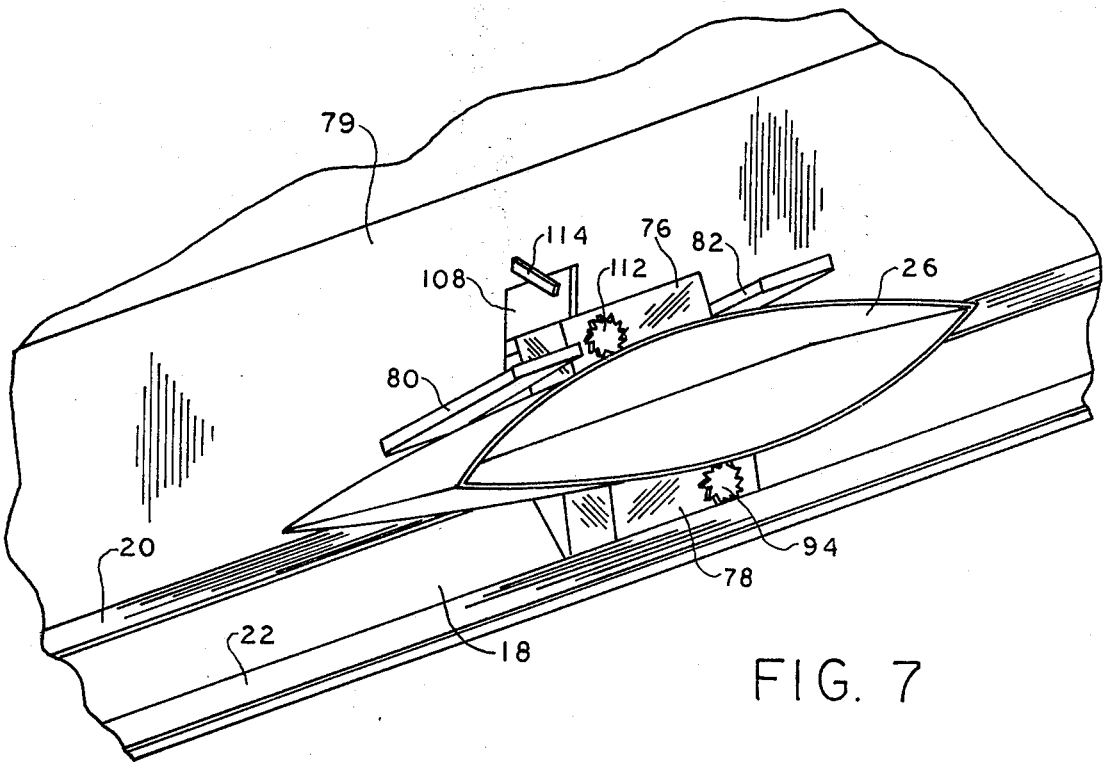
FIG. 7 is a partial perspective view of the machine, more particularly showing the attitude of an opened envelope at the processing station, for ready accessibility to the operator.

Referring again to FIG. 1, the envelope processing station 74 includes an envelope opening means comprising a pair of tacky adhesive means or envelope grippers 76 and 78 which are substantially identical to the gripper 48 of the feed means 44. As will be more fully described hereinafter, the tacky adhesive grippers 76 and 78 are arranged for reciprocal movement to engage opposite side panels of the envelope 26 and to thereafter open the envelope and retain the same in its open position as illustrated. As best seen in FIG. 7, extending from a side panel 79 of the machine is a pair of inclined arms 80 and 82 which are provided for stripping the envelope 26 from the upper gripper 76 in a manner presently to be described.

Referring now to FIG. 5, there is illustrated in greater detail the construction of the gripper 78 of the envelope opening means. Because the grippers 48, 76 and 78 are constructed in an identical manner, only gripper 78 need be described in detail herein. The gripper 78 includes a housing 84 adapted to receive the web supply roll 86 and the take-up roller 88. The web 90 extends from the supply roller 86 to the take-up roller 88 across a pressure pad 92. Coupled to the take-up roller 88 is a ratchet wheel 94 arranged to engage an incrementing arm 96. As in the case of the feed means gripper 48, when the gripper 78 returns to an initial position, the incrementing arm 96 engages the ratchet wheel 94 for incrementally rotating the take-up roller 88 to thereby provide a fresh supply of tacky adhesive web 90 on the pressure pad. Because the pressure pad 92 applies pressure to the envelopes, a retainer spring 100 is provided to prevent the supply roller 86 from rotating when the pressure pad 92 engages the envelopes. Furthermore, because at the time the pressure pad 92 engages the envelope the incrementing arm 96 is displaced from the ratchet wheel 94, the take-up roller 88 may include a one-way ball clutch or the like for preventing reverse rotation of the take-up roller. Such ball clutches are well known in the art. Web 90 preferably is provided with a tacky adhesive on one surface and a non-adhesive wax-like opposite face.

Figure 2:
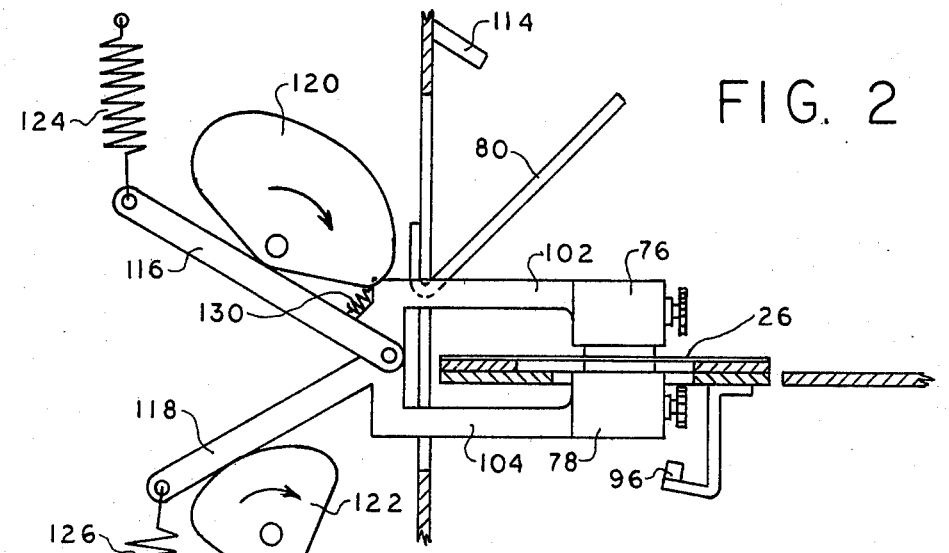
FIGS. 2 through 4 are partial diagramatic side views of the envelope processing station of the machine of FIG. 1 illustrating the operation of the envelope opening means.
Figure 3:
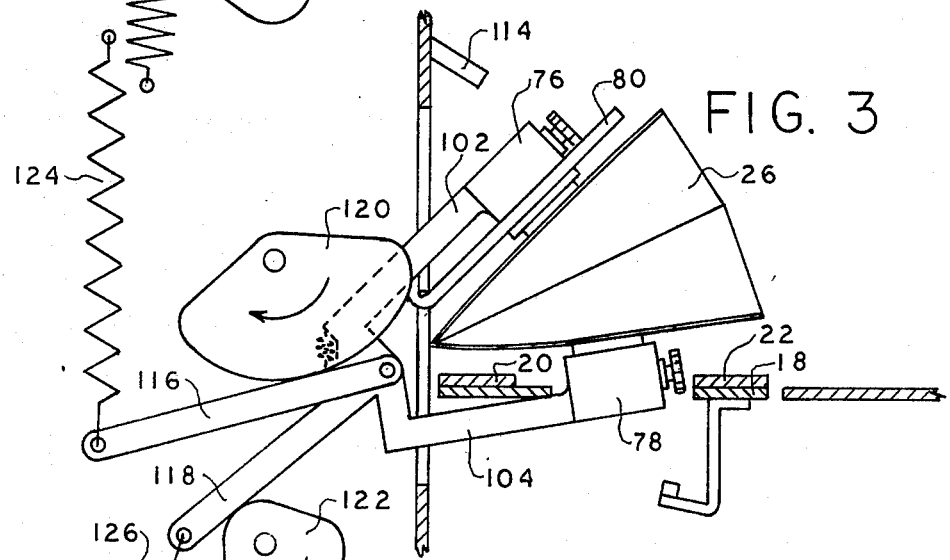
Figure 4:
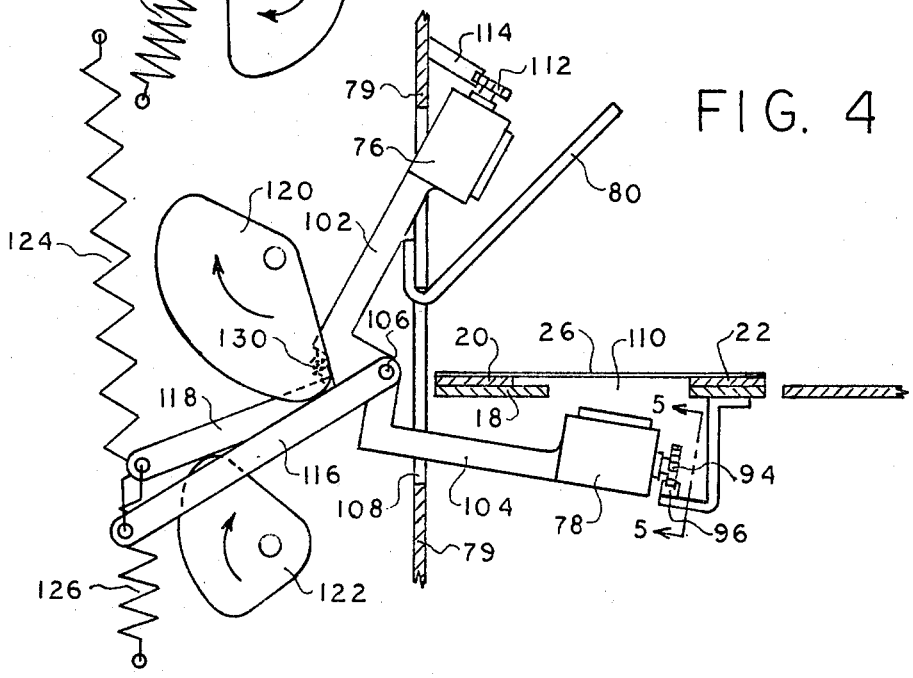

Referring now to FIGS. 2 through 4, they illustrate the manner in which the envelope processing station opens the severed envelopes and maintains the envelopes in an opened condition to facilitate the removal of contents therefrom by an operator. Initial attention is directed to FIG. 4 which illustrates the condition of the processing station at the moment an envelope reaches the processing station. It may first be noted that the envelope grippers 76 and 78 are at the end of respective arms 102 and 104 which are pivotally mounted on a pivot shaft 106. The panel 79 includes an opening 108 through which the arms 102 and 104 extend. The plate 18 includes an opening 110 which permits the gripper 78 to pass therethrough and to return to a retracted position as illustrated in FIG. 4. When in its retracted position beneath the plate 18, the ratchet wheel 94 engages the incrementing arm 96 in the previously-described manner. Similarly, gripper 76 has a ratchet wheel 112 which engages a corresponding incrementing arm 114 when it returns to its initial position as shown in the figure.

The arm 102 is coupled to and operated by an actuating arm 116 and the arm 104 is coupled to and operated by another actuating arm 118. The actuating arms 116 and 118 are arranged to be acted upon by respective eccentric rotatable cams 120 and 122 respectively. A spring 124 holds arm 116 against the eccentric cam surface of cam 120 while a second spring 126 pulls the arm 118 against the eccentric cam surface of cam 122. The cams 120 and 122 are rotated in timed relation in a manner to be described hereinafter to cause the grippers 76 and 78 to open the envelopes and retain the same in an open condition.

Figure 6:
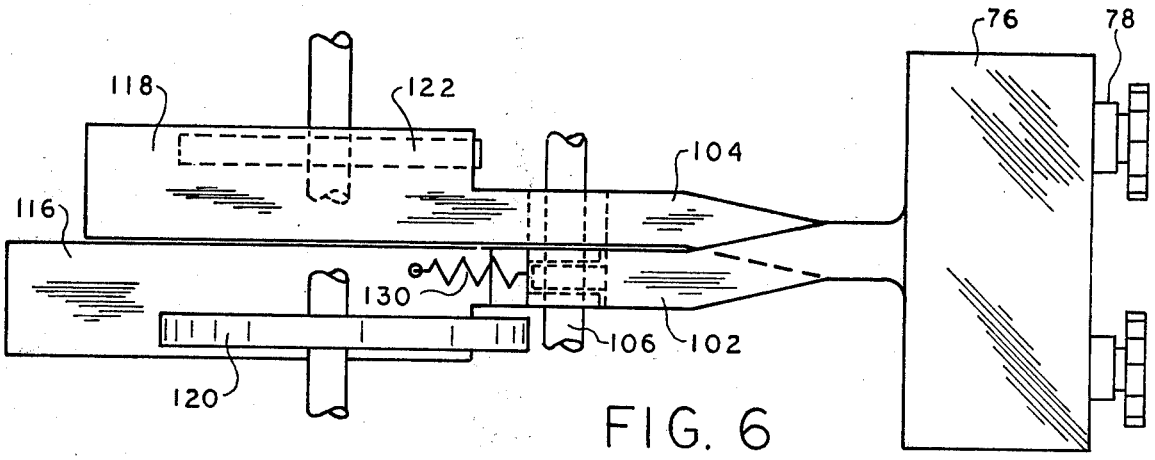
FIG. 6 is a partial top plan view of the envelope opening means of FIGS. 2 through 4.

Referring to FIG. 6 and to FIG. 2, it can there be noted that arm 102 which carries gripper 76 is coupled to the actuating arm 116 by a safety spring 130. As can be appreciated from the foregoing, the springs 130 and 124 associated with arms 116 and 102 provide a safety feature in that should an operator inadvertently get a hand in the path of the gripper 76 or its arm 102, the springs will prevent the operator from being injured. If desired, arm 104 and actuating arm 118 may be coupled together in a similar manner.

Referring to FIG. 4, an envelope 26 has been conveyed to the processing station on the belts 20 and 22. At this point in time, the grippers 76 and 78 are in their retracted positions.

The cams 120 and 122 are then rotated to cause the grippers 76 and 78 to engage opposite side panels of the envelope 26. When this is accomplished, the processing station appears as in FIG. 2.

After the grippers 76 and 78 have engaged opposite side panels of the envelope 26, the cams 120 and 122 are further rotated so as to separate the side panels of the envelope. At this stage of the process, it can be noted that each of the arms 102 and 104 is caused to pivot in a counter-clockwise direction, with the arm 102 pivoting to a greater extent than the arm 104 so as to cause the side panels of the envelope 26 to be separated. At this point, the envelope is not only rendered in an open and retained position, but further, is disposed at an angle relative to the plate 18 so that an operator may readily view into the envelope for manually gripping its contents. Once the contents of the envelope are removed, upon resumed rotation of cam 122, the arm 102 will be caused to pivot further in a counter-clockwise direction to its FIG. 4 position. As the arm 102 pivots towards its original position of FIG. 4, the strippers 80 and 82 engage the upper envelope side panels on opposite sides of the gripper 76 to strip the upper side panel of the envelope from the tacky adhesive of the gripper 76. Once the upper side panel is released from the gripper 76, cam 122 is further rotated for pivoting arm 104 in a clockwise direction to cause the gripper 78 to return to its initial retracted position as shown in FIG. 4. As the gripper 78 returns to its retracted position, the bottom side panel of the envelope 26 will engage the belts 20 and 22 and thus the support plate 118 which supports the belts. By virtue of the rigidity of the plate 118, the bottom panel of the envelope 26 is stripped from the tacky adhesive of the gripper 78. When the grippers 76 and 78 reach their initial positions as shown in FIG. 4, their respective ratchet wheels 112 and 94 will engage their respective incrementing arms 114 and 96 so as to incrementally rotate their take-up spools as previously described.

Now that the envelope has been opened, its contents removed, and once again placed upon the belts 20 and 22, the envelope is caused to be conveyed to a detecting station which detects the presence or absence of contents within an envelope. The detecting station 140 (FIG. 1) includes a detector or candling mechanism comprising a light source 142 and a photo cell 144. The light source 142 and photo cell 144 are spaced apart for receiving the envelope therebetween. When the light reaching the photo cell 144 from the light source 142 drops below a predetermined intensity, as for example when contents from an envelope have been overlooked or otherwise not removed, the machine remains stopped for so long as this condition exists. For a more complete description of such a detecting mechanism for use in such a machine as that shown in FIG. 1, reference may be had to the aforementioned application Ser. No. 801,454, now U.S. Pat. No. 4,159,611, which patent is incorporated herein by reference. That patent may additionally be referred to for a complete description of an illustrative control circuitry which causes the machine to function in a properly timed sequence.

Lastly, it can be noted in FIG. 1 that a foot switch 146 is provided. The foot switch 146 allows an operator to conveniently actuate and deactuate the machine while in a sitting position and with the operator's hands unoccupied. The control panel 148, as fully described in the aforementioned referenced patent, may be utilized for establishing the machine in an automatic sequence whereby one press of the foot pedal 146 causes the machine to run and continuously present opened envelopes to the operator, one at a time in succession, for the removal of the contents therefrom. Furthermore, the control panel 148 may be utilized to establish an operator controlled sequence of the machine so that each envelope may be incremented along to the processing station upon each depression of the foot pedal 146.

While a particular embodiment of the present invention has been shown and described, modifications may be made, and it is therefore intended to cover in the appended claims all such changes and modifications which fall within the true spirit and scope of the invention.

The invention is claimed as follows:

1. An envelope processing machine comprising: a supply hopper for envelopes; an envelope processing station, means for removing envelopes in one-by-one relationship from the supply hopper and for transmitting the removed envelopes to the envelope processing station; and envelope opening means at said processing station including a pair of relatively reciprocating tacky adhesive means arranged to pivot from a retracted position and to grip and separate opposite panels of an envelope to facilitate the removal of contents therefrom, said machine further including stripping means non-movably mounted on said machine for engaging only the outside panels of the envelope for removing said envelope panels from said tacky adhesive means upon said tacky adhesive means returning to retracted position.

2. An envelope processing machine as defined in claim 1 wherein said envelope opening means includes a pair of arms mounted for pivotal movement, each said arm having an end supporting a respective one of said tacky adhesive means.

3. An envelope processing machine as defined in claim 2 further including rotatable eccentric cam means arranged to act upon said arms for causing said arms to pivot in timed relation for enabling said tacky adhesive means to grip and separate the opposite panels of an envelope.

4. An envelope processing machine as defined in claim 2 wherein said arms comprise an upper arm and a lower arm, wherein said envelope transmitting means includes a plate and conveyor means for transmitting the envelopes to said processing station substantially parallel to said plate, wherein said plate includes an opening therein at said processing station, wherein said tacky adhesive means of said lower arm is arranged to reside beneath said plate adjacent said opening when in said retracted position, and wherein said plate is arranged to disengage said tacky adhesive means of said lower arm from its respective envelope panel upon being pivoted to its retracted position beneath said plate through said opening.

5. An envelope processing machine as defined in claim 1 wherein each said tacky adhesive means comprises a pressure pad and a web over said pad and carrying an adhesive on its surface opposite said pad.

6. An envelope processing machine as defined in claim 5 wherein said tacky adhesive means further comprises supply means for incrementally providing a fresh supply of said adhesive web over said pad.

7. An envelope processing machine as defined in claim 6 wherein said supply means includes a supply roll of said adhesive web, a take-up reel arranged for receiving said web from said roll after passing over said pad, and means for incrementally rotating said take-up wheel so as to maintain a fresh supply of adhesive for gripping the envelope panels.

8. An envelope processing machine as defined in claim 7 wherein said take-up roll is arranged to be incremented as said tacky adhesive means return to an initial retracted position.

9. An envelope processing machine as defined in claim 1 wherein said envelope removing means comprises a third tacky adhesive means arranged for reciprocal movement for gripping the envelopes one at a time and removing the same from the supply hopper.

10. An envelope processing machine as defined in claim 9 wherein said envelope removing means further includes an arm mounted for pivotal movement and having an end carrying said third tacky adhesive means.

11. An envelope processing machine as defined in claim 10 wherein said envelope transmitting means includes a plate and a conveyor, said plate having an opening, and wherein said third tacky adhesive means pivots from a retracted position beneath said plate and is arranged to place an envelope onto said conveyor upon passing through said plate opening and returning to said retracted position.

12. An envelope processing machine as defined in claim 11 wherein said third tacky adhesive means comprises a pressure pad and a web over said pad and carrying an adhesive on its surface opposite said pad.

13. An envelope processing machine as defined in claim 12 wherein said third tacky adhesive means further comprises supply means for incrementally providing a fresh supply of said adhesive web over said pad.

14. An envelope processing machine as defined in claim 13 wherein said supply means includes a supply roll of said adhesive web, a take-up reel arranged for receiving said web from said roll after passing over said pad, and means for incrementally rotating said take-up reel so as to maintain a fresh supply of adhesive for gripping the envelopes.

15. An envelope processing machine as defined in claim 14 wherein said take-up reel is arranged to be incremented as said third tacky adhesive means returns to said retracted position.

* * * * *